US006879291B2

(12) United States Patent
Duxbury et al.

(10) Patent No.: US 6,879,291 B2
(45) Date of Patent: Apr. 12, 2005

(54) OFFSETTING PATCH ANTENNAS ON AN OMINIDIRECTIONAL MULTI-FACETTED ARRAY TO ALLOW SPACE FOR AN INTERCONNECTION BOARD

(75) Inventors: Guy Duxbury, Nepean (CA); Robert Sheffield, Ottawa (CA); David Bolzon, Kanata (CA); Ian Abraham, Bishops Stortford (GB); Andrew Urquhart, Bishops Stortford (GB)

(73) Assignee: Nortel Networks Limited (CA)

( * ) Notice: Subject to any disclaimer, the term of this patent is extended or adjusted under 35 U.S.C. 154(b) by 0 days.

(21) Appl. No.: 10/684,092

(22) Filed: Oct. 10, 2003

(65) Prior Publication Data

US 2004/0174303 A1 Sep. 9, 2004

Related U.S. Application Data

(60) Provisional application No. 60/451,897, filed on Mar. 4, 2003.

(51) Int. Cl.[7] ..... H01Q 1/38
(52) U.S. Cl. ..... 343/700 MS; 343/754
(58) Field of Search ..... 343/700 MS, 824, 343/754, 853, 846

(56) References Cited

U.S. PATENT DOCUMENTS

| | | | | | |
|---|---|---|---|---|---|
| 4,162,499 | A | * | 7/1979 | Jones et al. | 343/700 MS |
| 4,816,836 | A | * | 3/1989 | Lalezari | 343/700 MS |
| 4,899,162 | A | * | 2/1990 | Bayetto et al. | 343/700 MS |
| 5,243,354 | A | * | 9/1993 | Stern et al. | 343/700 MS |
| 5,291,211 | A | * | 3/1994 | Tropper | 343/890 |
| 5,552,798 | A | * | 9/1996 | Dietrich et al. | 343/893 |
| 5,859,618 | A | * | 1/1999 | Miller et al. | 343/725 |

* cited by examiner

*Primary Examiner*—Tan Ho
(74) *Attorney, Agent, or Firm*—Ridout & Maybec LLP

(57) ABSTRACT

A multi-facetted antenna array is disclosed for omnidirectional signalling. The multi-facetted antenna array includes a plurality of abutting facets having a planar region under the patch antenna structures, and curving regions between the planar regions and across the abutting edges of the facets. The planar regions under the patch antenna provide proper RF antenna performance, while the curved regions minimize the size of the assembled array. Further disclosed is a method of mounting the associated RF interface module across an inside corner formed by abutting facets. The disclosed multi-facetted antenna array is particularly useful for overcoming the unsightly size and wind loading problems of multi-facetted antenna arrays known in the art.

18 Claims, 6 Drawing Sheets

OFFSETTING PATCH ANTENNAS ON AN OMINIDIRECTIONAL MULTI-FACETTED ARRAY TO ALLOW SPACE FOR AN INTERCONNECTION BOARD

RELATED U.S. APPLICATION DATA

This patent application claims priority to U.S. Provisional Patent Application No. 60/451,897 filed Mar. 4, 2003; the contents of which are hereby incorporated by reference.

This patent application is related to the following Provisional patent applications filed in the U.S. Patent and Trademark Office, the disclosures of which are expressly incorporated herein by reference:

- U.S. patent application Ser. No. 60/446,617 filed on Feb. 11, 2003 and entitled "System for Coordination of Multi Beam Transit Radio Links for a Distributed Wireless Access System"
- U.S. patent application Ser. No. 60/446,618 filed on Feb. 11, 2003 and entitled "Rendezvous Coordination of Beamed Transit Radio Links for a Distributed Multi-Hop Wireless Access System"
- U.S. patent application Ser. No. 60/446,619 filed on Feb. 12, 2003 and entitled "Distributed Multi-Beam Wireless System Capable of Node Discovery, Rediscovery and Interference Mitigation"
- U.S. patent application Ser. No. 60/447,527 filed on Feb. 14, 2003 and entitled "Cylindrical Multibeam Planar Antenna Structure and Method of Fabrication"
- U.S. patent application Ser. No. 60/447,643 filed on Feb. 14, 2003 and entitled "An Omni-Directional Antenna"
- U.S. patent application Ser. No. 60/447,644 filed on Feb. 14, 2003 and entitled "Antenna Diversity"
- U.S. patent application Ser. No. 60/447,645 filed on Feb. 14, 2003 and entitled "Wireless Antennas, Networks, Methods, Software, and Services"
- U.S. patent application Ser. No. 60/447,646 filed on Feb. 14, 2003 and entitled "Wireless Communication"
- U.S. patent application Ser. No. 60/453,011 filed on Mar. 7, 2003 and entitled "Method to Enhance Link Range in a Distributed Multi-hop Wireless Network using Self-Configurable Antenna"
- U.S. patent application Ser. No. 60/453,840 filed on Mar. 11, 2003 and entitled "Operation and Control of a High Gain Phased Array Antenna in a Distributed Wireless Network"
- U.S. patent application Ser. No. 60/454,715 filed on Mar. 15, 2003 and entitled "Directive Antenna System in a Distributed Wireless Network"
- U.S. patent application Ser. No. 60/461,344 filed on Apr. 9, 2003 and entitled "Method of Assessing Indoor-Outdoor Location of Wireless Access Node"
- U.S. patent application Ser. No. 60/461,579 filed on Apr. 9, 2003 and entitled "Minimisation of Radio Resource Usage in Multi-Hop Networks with Multiple Routings"
- U.S. patent application Ser. No. 60/464,844 filed on Apr. 23, 2003 and entitled "Improving IP QoS though Host-Based Constrained Routing in Mobile Environments"
- U.S. patent application Ser. No. 60/467,432 filed on May 2, 2003 and entitled "A Method for Path Discovery and Selection in Ad Hoc Wireless Networks"
- U.S. patent application Ser. No. 60/468,456 filed on May 7, 2003 and entitled "A Method for the Self-Selection of Radio Frequency Channels to Reduce Co-Channel and Adjacent Channel Interference in a Wireless Distributed Network"
- U.S. patent application Ser. No. 60/480,599 filed on Jun. 20, 2003 and entitled "Channel Selection"

FIELD OF THE INVENTION

The present invention relates to patch antenna arrays and is particularly concerned with minimizing the overall array dimensions of an omnidirectional multi-facetted array.

BACKGROUND OF THE INVENTION

Within a wireless communication system, it is strongly desirable for cellular antenna arrays to have minimal size for reasons of ease of installation, greater stability under wind loading conditions, and minimal visual obtrusiveness.

One variety of omnidirectional antenna used in cellular installations is a multi-facetted patch array. This type of antenna has a series of patch antenna on facets, and the facets are circumferentially disposed around an axis with each antenna facing outward. A minimum overall array size may be obtained when the facets abut one another, forming a faceted tube.

Existing patch antenna designs have a lower bound on facet sizes because of engineering limitations. These limitations are imposed due to space requirements for: patch antenna width for efficient operation at the required Gigahertz frequencies used in today's cellular systems; the patch antenna ground plane; the interconnection tracking; the printed circuit board (PCB) radio frequency (RF) switch; and the RF cabling used to interconnect to the RF amplifier modules. An antenna array of an unsightly size occurs when sufficient space is allotted for all these requirements on each facet. Further, wind loading characteristics of the resulting sized array imposes mounting stresses on the antenna array and tower.

In view of the foregoing, it would be desirable to provide a technique for providing a patch antenna on an omnidirectional multi-facetted array which overcomes the above-described inadequacies and shortcomings.

SUMMARY OF THE INVENTION

An object of the present invention is to provide an improved multi-faceted antenna array.

According to an aspect of the present invention there is provided an antenna array having a plurality of facets disposed around an axis, each of the facets having sides abutting the sides of an adjacent facet so as to form a faceted tube. There is at least one patch antenna disposed on each of the facets and at least one radio frequency interface module. A plurality of signal tracks disposed across the facets interconnects the patch antennas across the abutting sides to the radio frequency interface module. There is at least one ground plane separated from the at least one patch antenna and plurality of signal tracks by a dielectric having at thickness. Each facet has a substantially planar region under the patch antenna, and at least a first curved region under at least a portion of the signal tracks. The first curved region has a radius of curvature sufficient to avoid any discontinuities in RF propagation along the signal tracks.

Advantages of the present invention include a reduced array size over comparable arrays having strictly planar facets. The reduced array size provides for better wind loading and less visual obtrusiveness when installed.

Conveniently, each facet may have a second curved region under at least a portion of the plurality of signal tracks, from a side of the substantially planar region opposite to the side of said first curved region, to the abutting side of an adjacent facet of the plurality of facets, with the curved region having a radius of curvature designed so as to avoid any discontinuities in RF propagation along the signal tracks. Further, the substantially planar region of at least one of the plurality of facets may be disposed off-center of the midline of the facet. Conveniently, the radius of curvature the first or the second curved region may be in excess of ten times the dielectric thickness.

The offsetting of the substantially planar region over which the patch antenna on the facet is situated provides space on the facet for locating a radio frequency interface module, or at least a portion thereof.

Advantageously, the at least one radio frequency interface module is disposed across an inside corner formed at the connectively abutting sides of two adjacent facets of the plurality of facets. This placement of the radio frequency interface module has the advantage of further reducing the width requirements for the facet upon which the radio frequency module is at least partially sited.

In accordance with another aspect of the present invention there is provided a method for forming an antenna array including the steps of disposing a plurality of facets around an axis, each of the plurality of facets having sides connectively abutting the sides of an adjacent facet, the plurality of facets forming a faceted tube, and disposing at least one patch antenna on each of the plurality of facets. Further, the method comprises disposing at least one radio frequency interface module within the array, and disposing a plurality of signal tracks across the plurality of facets interconnecting the patch antennas across the connectively abutting sides to the radio frequency interface module. Additionally, the method comprises disposing a ground plane separated from the at least one patch antenna and plurality of signalling tracks by a dielectric having a thickness, and configuring each facet to have a substantially planar region under the at least one patch antenna, and each facet to have at least a first curved region under at least a portion of the plurality of signal tracks. The first curved region has a radius of curvature designed so as to avoid any discontinuities in RF propagation along the signal tracks.

Conveniently, the configuring step has each facet having a second curved region under at least a portion of the plurality of signal tracks, from a side of the substantially planar region opposite to the side of said first curved region, to the abutting side of an adjacent facet of the plurality of facets. Also conveniently, the configuring step further has at least one of the substantially planar region of at least one of the plurality of facets disposed off-center of the midline of the facet.

Conveniently, the radius of curvature the first or the second curved region may be in excess of ten times the dielectric thickness.

Advantageously, the step of disposing the at least one radio frequency interface module within the array further comprises disposing the least one radio frequency interface module across an inside corner formed at the abutting sides of two adjacent facets of the plurality of facets.

The present invention will now be described in more detail with reference to exemplary embodiments thereof as shown in the appended drawings. While the present invention is described below with reference to the preferred embodiments, it should be understood that the present invention is not limited thereto. Those of ordinary skill in the art having access to the teachings herein will recognize additional implementations, modifications, and embodiments which are within the scope of the present invention as disclosed and claimed herein.

BRIEF DESCRIPTION OF THE DRAWINGS

The invention will be further understood from the following detailed description of embodiments of the invention and accompanying drawings in which.

DETAILED DESCRIPTION

Figure 1:
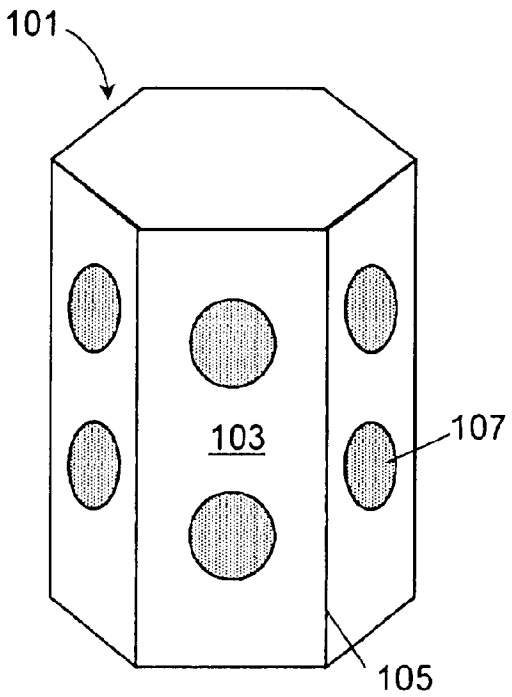
FIG. 1 is a perspective view of a multi-facetted antenna array.

In the discussion that follows, like reference numbers refer to like elements in similar figures. Referring to FIG. 1 there may be seen an example multi-section antenna array 101 in perspective view. The array is formed by a number of facets 103, the total quantity being a function of the particular application but typically comprising six or eight in total. The facets are arranged with abutting sides 105 which form edges or corners of the resultant polygonal tube. The facets need not be separate units, but instead may be formed on a single or convenient number of sheets which are effectively creased or folded at the edges of the facets. Located upon the facets are the patch antenna elements 107 which radiate or receive the requisite radio frequency (RF) signal. As is generally known, the patch antenna elements 107 have an associated ground plane (not shown) located beneath the patch antenna element, and separated from the conductive surface of the patch antenna element by a dielectric material. The thickness of the dielectric material, as well as the associated dielectric constant of the material, are characteristics determinant of the patch antenna performance.

Figure 2:
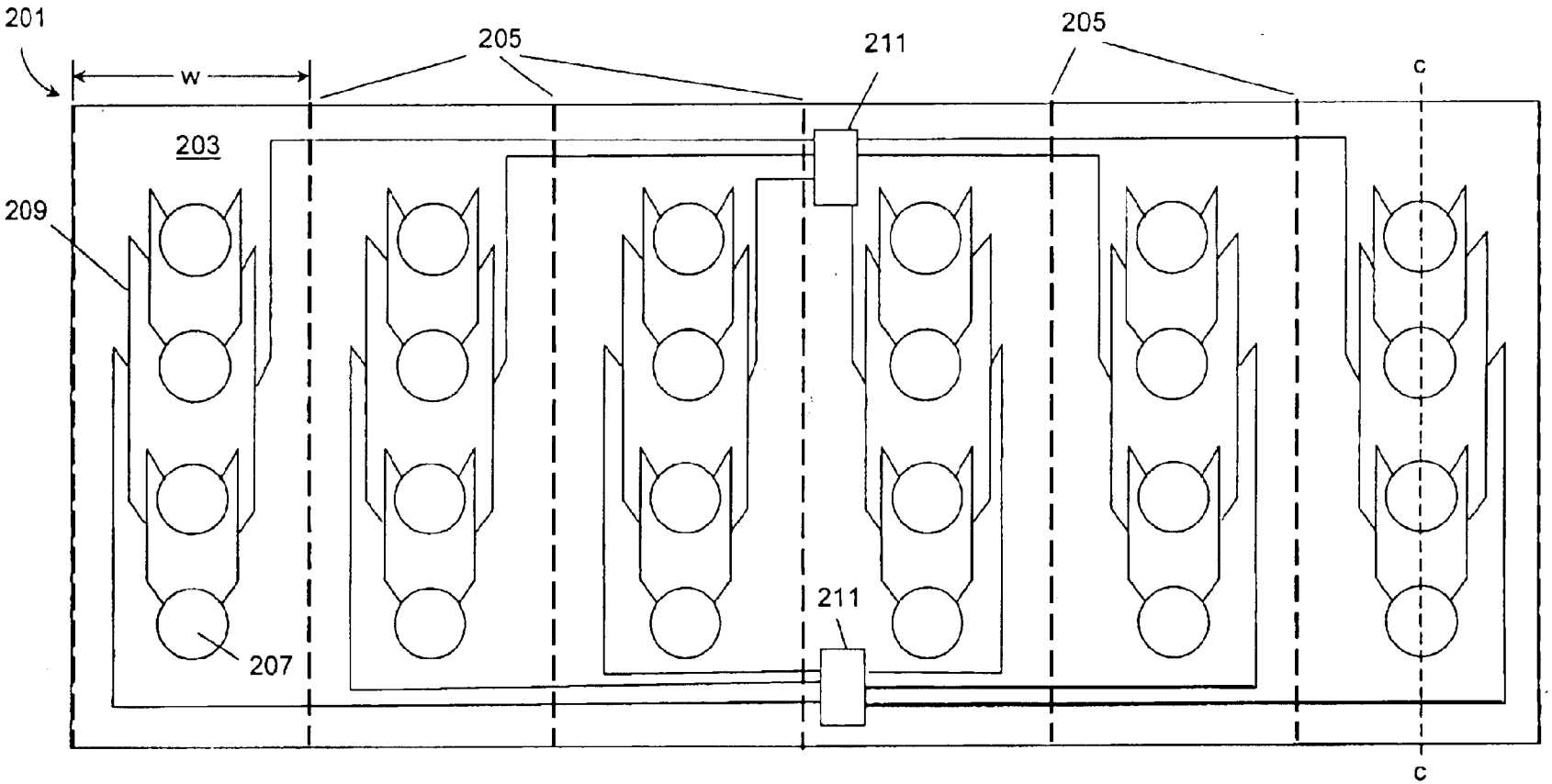
FIG. 2 is an unfolded view of a multi-facetted antenna array.

Referring to FIG. 2, there may be seen an unfolded version of an example multi-section antenna array 201. An array facet 203 may be seen bounded by the facet side edges 205. Also visible are the patch antenna 207 on the facets. Additionally, interconnecting tracks 209 may be seen. These are conductive elements, for example conductive tracks or microstrips, used to couple the signals to and from the patch antennas, and to link the patch antennas to generate appropriate phase and polarization relationships. These conductive elements, similar to the patch antenna elements, are also typically associated with one or more ground planes, being separated from the ground plane or multiple ground planes by a dielectric material having an associated dielectric constant and thickness.

The interconnecting tracks 209 terminate on a radio frequency interface module 211 which is mounted on the antenna array so as to receive the tracks. In this figure the radio frequency interface module 211 has been shown placed on a particular position for illustration purposes only, and may be placed in alternative arrangements as more particularly described in the following discussion. The RF interface module or board acts to connect and disconnect the various patch antennas on the facets according to the transmission and reception needs of the radio site being served by the antenna array. RF cabling from the RF interface module connects to RF modules, typically power amplifiers and receiving circuitry. The RF interface module may implement a switch function, so that the patch antenna on one particular facet may be routed to the RF modules. Alternatively, a beam forming or other phase aligned combination function may be implemented within the RF interface module. Depending upon what functionality is being implemented a particular antenna array may use a single RF interface module or multiple modules as illustrated in FIG. 2. As the RF interface module needs to connect to the facets to receive the interconnecting tracks 209, the issue arises as to how to site the RF interface module, and the impacts of possible siting choices. In the following description of embodiments of the invention, the RF interface module is described as performing switching functions. However, it is to be understood that in generd, the RF interface module may encompass arbitrary radio functions.

In FIG. 2 the facets 203 may be seen to be equivalent in size with the patch antennas 207 situated substantially along a center line c—c of each facet. The net result of this arrangement for the resulting array is a symmetrical unit exhibiting predictable wind loading characteristics. In general, each facet has a minimum width w determined by the sum of the actual patch antenna width, the additional extension width that the associated ground plane for the patch antenna must occupy, and the tracking space required to connect to each antenna patch.

Figure 3:
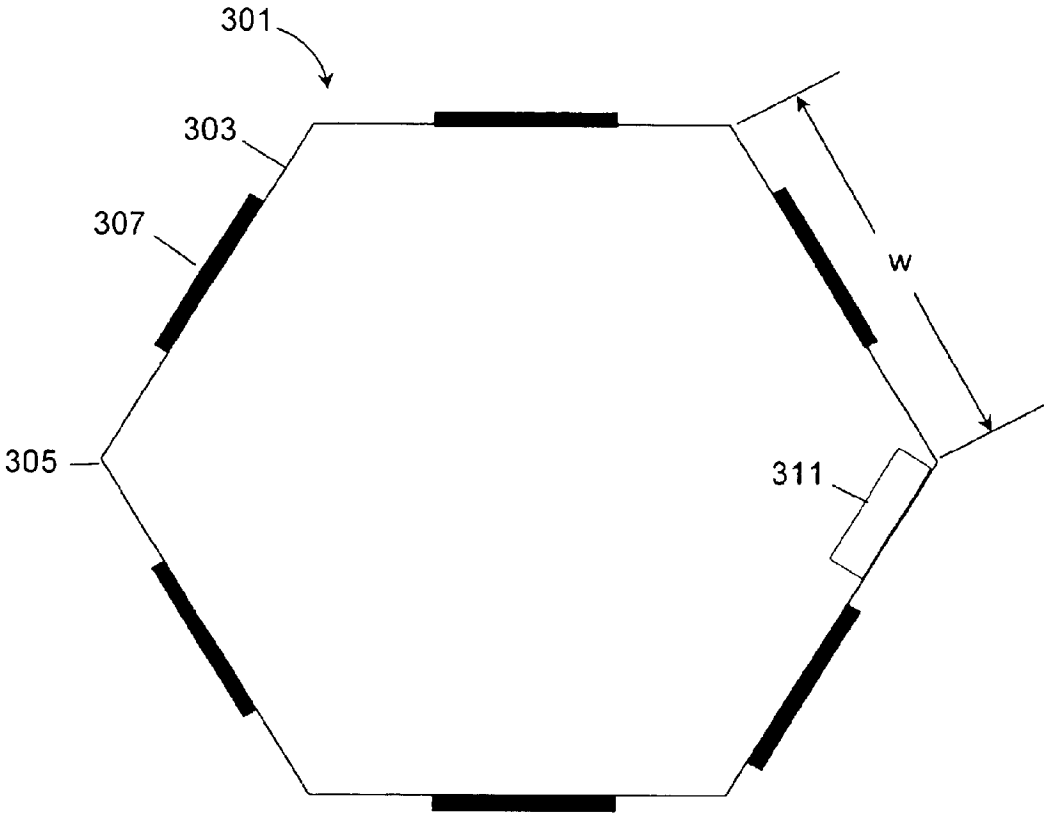
FIG. 3 is a top view of a multi-facetted antenna array having symmetrical facets.

Referring now to FIG. 3, there is depicted a top view of an antenna array 301 in which the width w of each facet 303 has been increased so as to provide room on one of the facets for the RF interface module 311. Also visible are the patch antenna 307 (not to scale in terms of thickness) and facet abutting edges 305. The overall size of the array has been increased symmetrically, and the resulting antenna array size exceeds the desirable nonobtrusiveness. For an antenna array with patch antenna widths appropriate to the 5.5 GHz region of the spectrum, the resultant size imposes undesirable mounting loads and is deemed unsightly.

Figure 4:
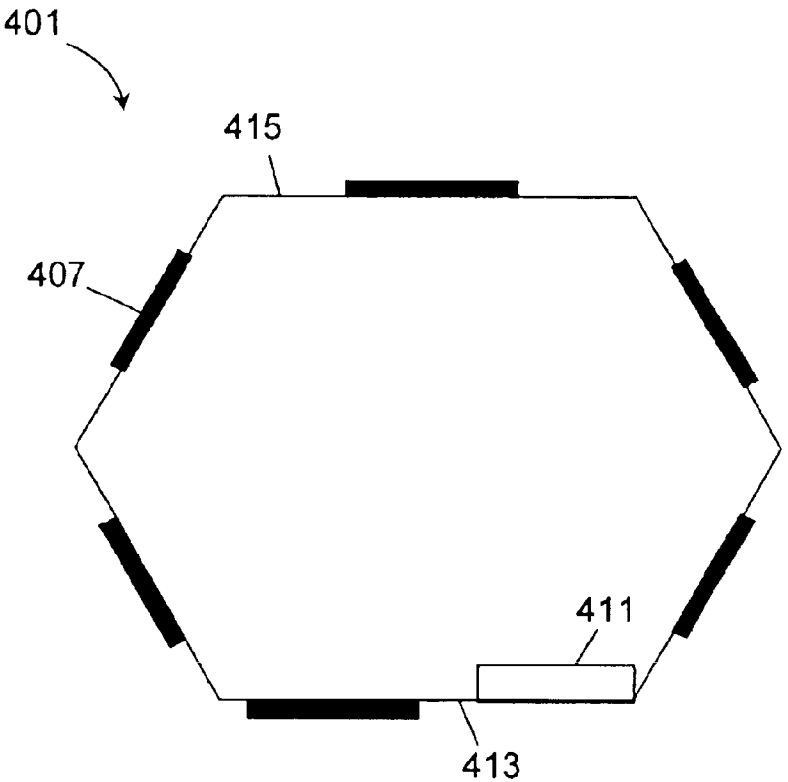
FIG. 4 is a top view of a multi-facetted antenna array having asymmetrical facets according to an embodiment of the invention.

Referring now to FIG. 4, there is shown a top view of an alternative antenna array 401 according to an embodiment of the invention in which the width of one of the facets 413 has been increased to allow for siting of the RF interface module 411. In order to maintain symmetry, opposing facet 415 has also had a width increase. The width of the remaining facets is chosen to minimize the overall profile of the array. Opposed facets in arrays with an even number of facets are typically matched in length in order to achieve the desired equiangular omnidirectional coverage. The net result is an antenna array which is smaller than the equivalent array as described in relation to FIG. 3. However, this version of antenna array proved more disturbed by wind than a symmetrical array, exhibiting vibration when wind loaded.

Figure 5:
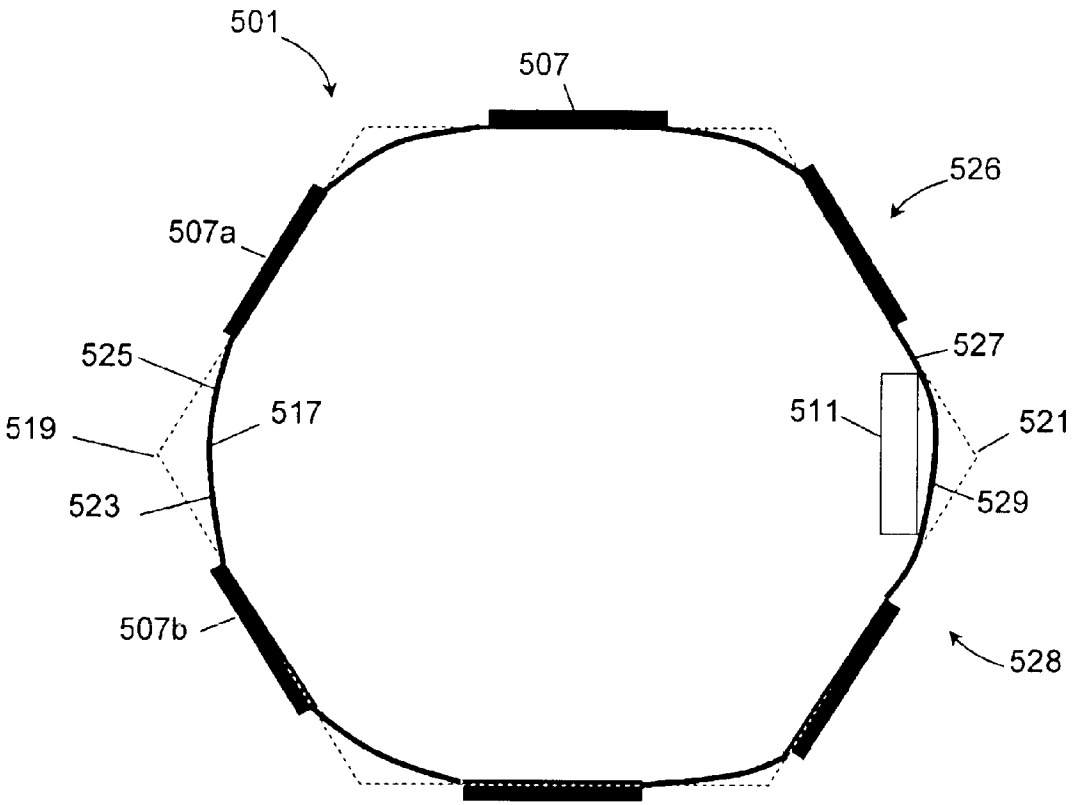
FIG. 5 is a top view of multi-facetted antenna array according to a alternative embodiment of the invention.

Referring now to FIG. 5, there is depicted a top view of an alternative antenna array 501 according to a different embodiment of the invention. Patch antenna 507 may be seen as in the previous figures, however modifications to the portion of the facets outside of the patch antenna portions have been made. In particular, referring to patch antennas 507*a* and 507*b*, it may be seen that the portions of the facets 523 and 525 between these patch antennas has been given a gentle curvature 517. These sections of the facets contain the interconnecting tracks. Normally, bending losses associated with curving the tracks would lead one skilled in the art to avoid adding a curvature to a facet, however it was determined that bend radiuses in excess of ten times the dielectric thickness would have minimal transmission losses. Thus, it became possible to utilize curvature as an aspect of the facets. Note that an even distribution of curvature 517 tends to blur the abrupt edge between abutting sides of the facets, however, the sides of the facets are still to be considered as lying at some point along the curvature 517.

In alternative embodiments of the invention, less radii of curvature are contemplated wherein signal propagation discontinuities due to the bending are traded off against the overall size of the antenna array and resulting size of the faceted tube shape. Similarly, localized adjustments to the width of the interconnecting tracks may be applied in order to compensate for the discontinuity effects of the bend curvature of tracks above the ground plane.

Additionally, there was also a concern that shifting a portion of the patch antennas partially around a corner bend would significantly degrade antenna performance as the ground planes beneath the patch antennas would be curved as well. Simulations showed that the required ground planes could be reduced to little more than the basic antenna patch width, thus allowing curvature exterior to the antenna patch.

The net result of the curvature was a reduction in overall array size as may be seen by the outline 519 of the normal polygonal (such as that shown in FIG. 3) relative to the resultant position 517 of the curved portion of the facets. The curvature can be disposed on one side of the patch antenna only, should such an arrangement be desired, but more normally the curvature would be on both sides of the patch antenna extending to the edge of the facet.

Yet a further aspect of the invention may be seen in FIG. 5 at the position of the RF interface module 511. The RF interface module 511 is mounted across the inner corner 521 formed by the abutting sides 527 and 529 of two of the facets 526 and 528. The positioning of the RF interface module with a side on each of the facets allows connection at the facet surface, yet reduces the area required for the RF interface module on the facet. This reduction in area further serves to reduce the overall size of the resultant antenna array.

Figure 6:
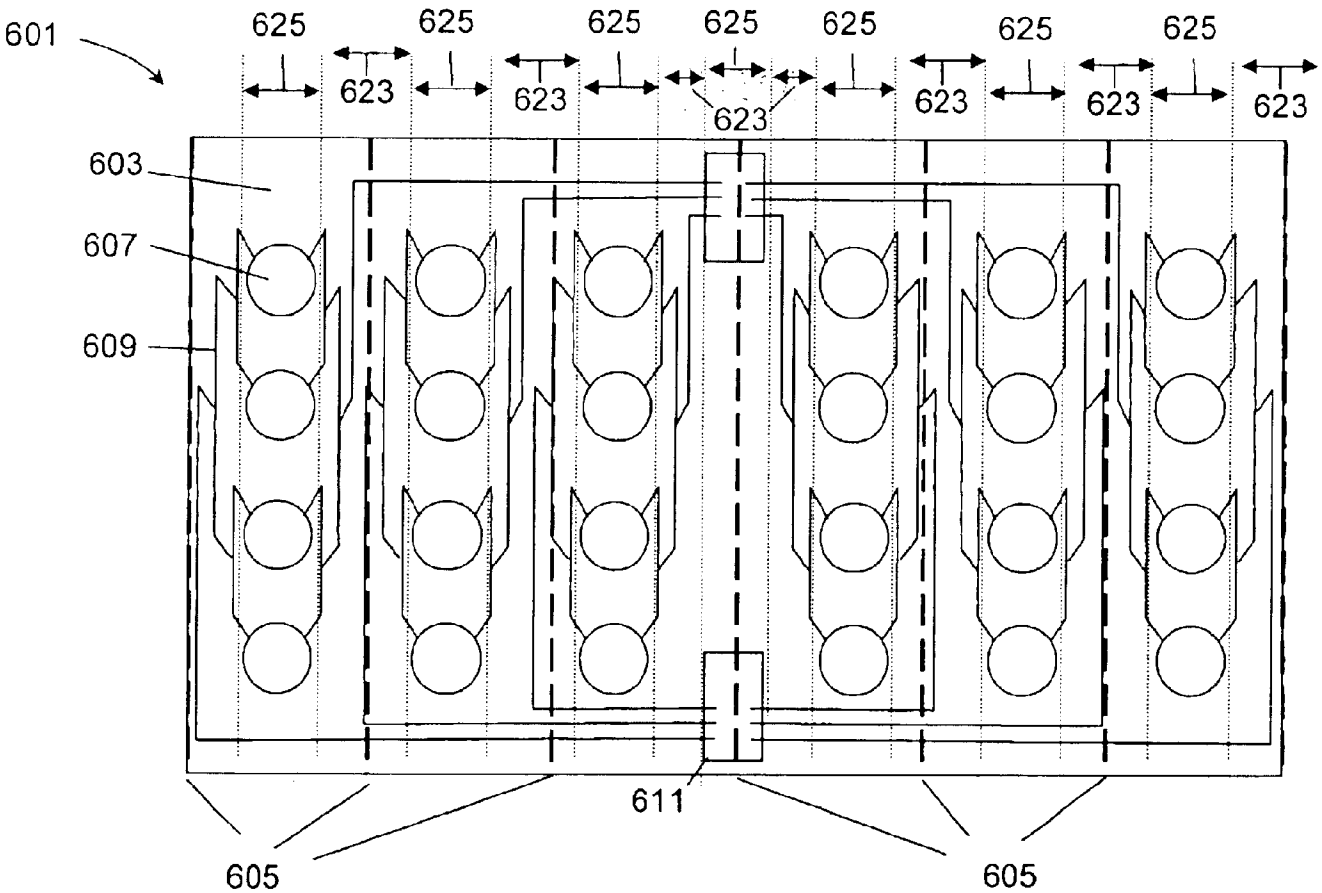
FIG. 6 is an unfolded view of the multi-facetted antenna array depicted in FIG. 5.

In FIG. 6 there is a depiction of an antenna array 601 as described for FIG. 5, but in opened form showing the disposition of the facets 603, the facet edges 605, the patch antennas 607, the interconnecting tracking 609, and the RF interface module 611. Visible in this figure is the non-central placement of the patch antennas relevant to the facets, i.e. the patch antenna elements 607 are placed on facets off of the center line of the facet when it is advantageous to do so for routing the interconnecting tracking 609. Particularly pointed out are regions 623 where appropriate bending to form the curved orientation shown in FIG. 5 is allowed, and areas 625 where such bending is proscribed.

In an antenna of this type, the overall antenna may be formed of a single overall panel which is manipulated to yield the final array, or of smaller assemblages. For example, the symmetry of the panels may allow a two panel assembly, with the RF interface module placed at the corner of the abutting sides of the two panels. An alternative contemplated embodiment could be an assembly wherein the patch antennas are formed on a metallized film which is subsequently assembled via a flexible wrap around band.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the broad scope of the appended claims.

What is claimed is:

1. An antenna array comprising:

a plurality of facets disposed around an axis, each of said plurality of facets having sides connectively abutting the sides of an adjacent facet, said plurality of facets forming a faceted tube;

at least one patch antenna disposed on each of said plurality of facets;

at least one radio frequency interface module disposed therein;

a plurality of signal tracks disposed across said plurality of facets interconnecting said patch antennas across said connectively abutting sides to said radio frequency interface module;

at least one ground plane, separated from said at least one patch antenna and said plurality of signal tracks by a dielectric having a thickness; and each facet having a substantially planar region thereunder said at least one patch antenna, and each facet having a first curved region under at least a portion of said plurality of signal tracks, wherein said first curved region has a radius of curvature great enough to avoid discontinuities in RF propagation along said signal tracks.

2. The antenna array of claim 1 wherein said first curved region has a radius of curvature in excess of ten times the dielectric thickness.

3. The antenna array of claim 1 wherein each facet has a second curved region under at least a portion of said plurality of signal tracks from a side of said substantially planar region opposite to the side of said first curved region to the abutting side of an adjacent facet of said plurality of facets, wherein said second curved region has a radius of curvature great enough to avoid discontinuities in RF propagation along said signal tracks.

4. The antenna array of claim 3 wherein said second curved region has a radius of curvature in excess of ten times the dielectric thickness.

5. The antenna array of claim 4 wherein said first curved region has a radius of curvature in excess of ten times the dielectric thickness.

6. The antenna array of claim 1 wherein at least one of said substantially planar region of at least one of said plurality of facets is disposed off-center of a center line of the facet.

7. The antenna array of claim 1 wherein the at least one radio frequency interface module is disposed across an inside corner formed at the connectively abutting sides of two adjacent facets of said plurality of facets.

8. The antenna array of claim 1 wherein the number of facets is six.

9. The antenna array of claim 1 wherein the number of facets is eight.

10. A method for forming an antenna array, the method comprising:

disposing a plurality of facets around an axis, each of said plurality of facets having sides abutting the sides of an adjacent facet, said plurality of facets forming a faceted tube;

disposing at least one patch antenna on each of said plurality of facets;

disposing at least one radio frequency interface module within said array;

disposing a plurality of signal tracks across said plurality of facets interconnecting said patch antennas across said connectively abutting sides to said radio frequency interface module;

disposing at least one ground plane separated from the at least one patch antenna and plurality of signalling tracks by a dielectric having at thickness; and configuring each facet to have a substantially planar region under said at least one patch antenna, and each facet to have a first curved region under at least a portion of said plurality of signal tracks, wherein said first curved region has a radius of curvature great enough to avoid discontinuities in RF propagation along said signal tracks.

11. The method of claim 10 wherein said first curved region has a radius of curvature in excess of ten times the dielectric thickness.

12. The method of claim 10 wherein said configuring step further comprises each facet has a second curved region under at least a portion of said plurality of signal tracks from a side of said substantially planar region opposite to the side of said first curved region to the abutting side of an adjacent facet of said plurality of facets, wherein said second curved region has a radius of curvature great enough to avoid discontinuities in RF propagation along said signal tracks.

13. The method of claim 12 wherein said second curved region has a radius of curvature in excess of ten times the dielectric thickness.

14. The method of claim 13 wherein said first curved region has a radius of curvature in excess of ten times the dielectric thickness.

15. The method of claim 10 wherein said configuring step further comprises at least one of said substantially planar region of at least one of said plurality of facets is disposed off-center of a center line of the facet.

16. The method of claim 10 wherein the step of disposing at least one radio frequency interface module within said array further comprises disposing the least one radio frequency interface module across an inside corner formed at the abutting sides of two adjacent facets of said plurality of facets.

17. The method of claim 10 wherein the quantity of said plurality of facets is six.

18. The method of claim 10 wherein the quantity of said plurality of facets is eight.

* * * * *